United States Patent [19]

Longsdorf et al.

[11] 4,186,682

[45] Feb. 5, 1980

[54] BELL AND CLAPPER ASSEMBLY

[75] Inventors: Ronald W. Longsdorf, Kansas City, Mo.; Clifford P. Cutler, Overland Park, Kans.

[73] Assignee: Hallmark Cards, Incorporated, Kansas City, Mo.

[21] Appl. No.: 961,655

[22] Filed: Nov. 17, 1978

[51] Int. Cl.[2] ..... G10K 1/06

[52] U.S. Cl. ..... 116/171; D11/157

[58] Field of Search ..... 116/171, 152, 170, 148, 116/150; 428/11; D11/157; 84/406

[56] References Cited

U.S. PATENT DOCUMENTS

| | | | |
|---|---|---|---|
| D. 244,678 | 6/1977 | Weimer | D11/157 |
| 2,597,522 | 5/1952 | Pierce | 116/152 |

OTHER PUBLICATIONS

Gifts and Decorative Accessories; Dec. 1972, p. 63.

*Primary Examiner*—S. Clement Swisher
*Assistant Examiner*—Denis E. Corr
*Attorney, Agent, or Firm*—Schmidt, Johnson, Hovey & Williams

[57] ABSTRACT

A bell and clapper assembly is provided comprising a transparent glass bell housing and hollow handle integral therewith wherein a clapper having an aesthetic appearance of selected design motif is removably mounted in the bell housing. A clapper of selected design may readily be suspended in the bell by the supplier, the retailer or at a subsequent time by the purchaser by virtue of the fact that the clapper is carried by a flexible chain having a sleeve at the upper end thereof which aligns with an opening at the top of the handle and removably receives the threaded post of a decorative rosette fastener engaging the top surface of the bell handle.

8 Claims, 4 Drawing Figures

BELL AND CLAPPER ASSEMBLY

TECHNICAL FIELD

This invention relates to a decorative bell and clapper assembly wherein the bell housing is of transparent material such as glass of a thickness to produce a characteristic ring when struck by a clapper, and unique structure is provided for suspending the clapper in the bell barrel in a manner permitting ready installation of any one of a number of clappers each having a distinctive design motif. In particular, the clapper may have a configuration appropriate for a special season, be designed to educe a particular emotional response, chosen to signify a nostalgic event for the purchaser, or simply present a pleasing ornamental appearance. The clapper suspension structure allows the manufacturer, distributor or customer to mount a selected clapper in the bell housing without modification of the latter and in accordance with a simple and inexpensive assembly procedure.

BACKGROUND ART

Small table or shelf bells have grown in popularity in recent years and have become collectors' items as increasingly attractive designs have been developed to present a more interesting and aesthetically pleasing appearance. Many of these bells utilize handblown glass bell housings which are of a thickness giving a required ringing sound when struck with a clapper, and allowing the viewer to see the interior of the bell housing so that the clapper becomes a part of the overall design. Oftentimes the surface of the bell housing is provided with ornamental etched markings thereon and frequently parts of the housing such as the handle are given cut glass treatment to enhance the aesthetic appeal of the design. Problems have been encountered though in suspending the clapper from the bell housing and especially the handle thereof, because of the difficulty of attaching the clapper to a glass product and the care required during assembly to prevent breakage. In order to preserve the necessary ringing properties of the housing, it is essential that the glass wall of the bell be relatively thin. This militates against securing the clapper to the housing with techniques that require significant heating thereof, and suspension components used in attaching the clapper cord or chain to the bell housing often detract from the overall appearance of the article. These problems have not heretofore been satisfactorily solved in all material respects.

DISCLOSURE OF INVENTION

The problems with prior glass bell and clapper assemblies alluded to above have been solved in the present invention by the provision of novel suspension structure for the clapper allowing the manufacturer, his distributor or the ultimate customer to select any one of a large number of clappers each having a different aesthetic configuration, and mount such clapper in the bell housing by the simple expedient of passing an internally threaded sleeve secured to the end of the clapper chain opposite the clapper, through an opening in the upper end of the integral, tubular glass handle of the bell housing whereupon a rosette having a threaded post thereon may be threaded into the sleeve to firmly affix the clapper to the bell handle. Mounting of the clapper on the bell housing is facilitated by the utilization of a threading needle which is releasably secured to the clapper sleeve and then threaded upwardly through the tubular bell handle until the sleeve extends through the opening in the upper end of the handle whereupon the needle may be removed and the rosette post turned down into the connector sleeve. Economies are affected in connection with the manufacture and assembly of the bell since all components may be standard with the sole exception of the clapper itself which as noted may have a particular design motif presenting a specific appeal.

BEST MODE OF CARRYING OUT THE INVENTION

Figure 1:
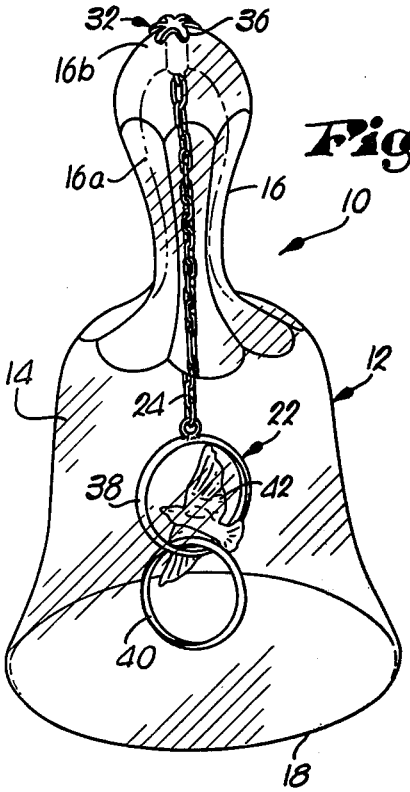
FIG. 1 is a perspective view of a bell and clapper assembly constructed in accordance with the preferred concepts of the present invention and showing one type of aesthetically appealing clapper suspended within the glass bell housing.

A bell and clapper assembly embodying the preferred concepts of this invention is broadly designated by the numeral 10 in the drawings and includes a transparent bell housing 12 of glass which generally is of the handblown type providing a relatively thin sidewall which gives a characteristic ringing sound when struck with a clapper. The thin walled barrel 14 of housing 12 merges into and is integral with a tubular glass handle 16 which may for example have decorative cut glass surfaces or the like **16*a* ground in the outer face thereof to enhance the appearance of the bell. The opposite end of the barrel 14 merges into a sound bow forming a part of the overall housing 12. Assembly 10 is especially adapted for resting on the lower circular rim 18 of housing 12** when not in use.

The uppermost extremity **16*b* of handle 16 has an opening 20 extending therethrough aligned with the axis of tubular handle 16 as well as barrel 14. A clapper 22** for the bell is provided which may be made from any selected material having sufficient mass to effect the required ringing sound as for example cast metal or glass.

Means for suspending the clapper 22 from handle 16 includes a flexible support element 24 in the nature of a decorative chain connected to the ring 26 secured to clapper 22. An internally threaded, elongated metallic connector sleeve 28 is joined to the opposite end of chain element 24 through the medium of a ring 30 affixed to the closed end **28*a*** of the sleeve.

In the assembled condition of the clapper, connector sleeve 28 passes through opening 20 and handle 16 and is secured therein by a rosette fastener 32 having an externally threaded post 34 removably received in sleeve 28 and provided with a series of radially projecting, longitudinally arcuate, decorative legs 36 which substantially complementally overlay the upper curved surface of handle 16.

Figure 2:
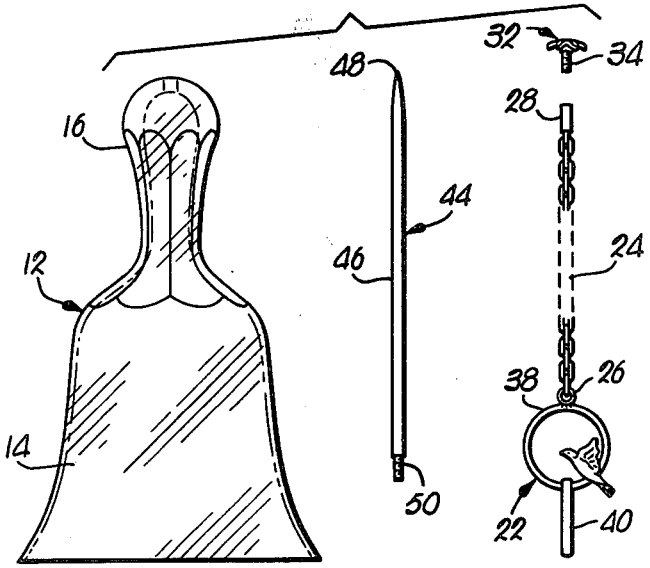
FIG. 2 is an exploded view of the assembly depicted in FIG. 1 and illustrating how a needle externally threaded at one end thereof may expeditiously be used to facilitate suspension of the clapper from the handle of the bell housing.

As is apparent from FIGS. 1 and 2, clapper 22 is typical of an aesthetically appealing design which adds to the overall appearance of the bell assembly 10. In the exemplary design, clapper 22 is of metal and comprises a pair of rings 38 and 40 one encircling the other, with a spread-wing bird 42 positioned within the upper ring 38.

Figure 4:
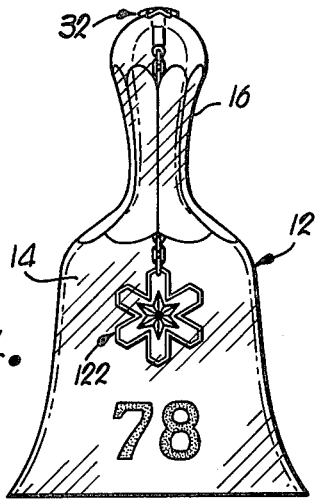
FIG. 4 is a side elevational view of another bell and clapper assembly embodying the principles of the invention and showing how a clapper having a different aesthetic configuration than shown for example in FIG. 1 may be easily and readily suspended from the handle of the bell housing.
Figure 3:
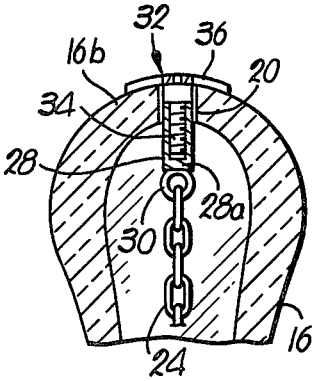
FIG. 3 is an enlarged, fragmentary, vertical cross-sectional view through the upper end of the handle of the bell housing and showing the specific mounting structure for suspending the clapper from the bell handle.

As is evident from the alternate embodiment of the invention shown in FIG. 4, a clapper 122 of totally different design from clapper 22 may be mounted within the bell housing 12 in that the structure for suspending the clapper from the handle 16 is the same as that illustrated in FIG. 1. In addition, numerals such as "78" indicating the year of purchase of the bell may be provided on the sidewall of barrel 14 to further enhance the appearance of the article and provide the purchaser with a memento of the year of acquisition. Although only two specific clapper designs have been illustrated for purposes of explaining the present invention, it is manifest that a multitude of clapper designs may be furnished to signify different events, seasons of the year, or other desired symbols and that such clappers may be manufactured of many different suitable materials, and if desired in view of the nature of the article fabricated in accordance with jewelry construction techniques.

Suspension of a selected clapper from the bell housing 12 may be readily accomplished by either the manufacturer, his distributor or the customer in the event he wishes to change the clapper at any time, by virtue of the provision of an elongated needle 44 having a shaft 46 pointed at one end 48 and externally threaded at the opposite end 50 for releasable receipt in the sleeve connector 28. After joining of needle 44 to sleeve 28, the needle may be threaded upwardly through the opening 20 in handle 16 until connector 28 is telescoped into opening 20. At this time, the needle 44 may be unthreaded from connector sleeve 28 and replaced with the rosette fastener 32.

Although a post rosette is the preferred fastener for securing sleeve 28 within opening 20, it is to be appreciated that a number of different fastener designs may be employed for purposes of this invention and the scope hereof is not to be limited by the specific shape of the rosette post.

INDUSTRIAL APPLICABILITY

The bell and clapper assembly 10 may be used for various design applications and permits the manufacturer to order or produce a limited number of bell designs and to assemble any one of a much larger number of clapper configurations within the housing of the bell. Furthermore, the concepts of this invention allow the manufacturer to ship bell housings and a number of clapper designs to a distributor or retailer who may then assemble the unit at the point of customer sale and in accordance with the purchaser's instructions. This results in a considerable saving in the inventory by the manufacturer or distributor as the case may be and does not require appreciable effort on the part of the assembler to incorporate a desired clapper in the bell in that a selected clapper may be readily and quickly mounted in the bell housing. In the same vein, the customer if desired may purchase a different clapper design at a subsequent time and insert such new clapper in the bell housing in place of the original clapper unit.

The bell assembly of this invention has especial utility as a gift item and has a higher intrinsic value because of the ability of the purchaser to custom order or fabricate a bell in accordance with his specific tastes. Furthermore, if the manufacturer or his distributor finds that a particular clapper motif is not selling as well as anticipated, the clapper may be changed at will without a loss on the merchandise as would occur with a permanent clapper assembly.

Having thus described the invention, what is claimed as new and desired to be secured by Letters Patent is:

1. A bell and clapper assembly comprising:

a bell housing provided with a barrel and sound bow of transparent material of a thickness and physical characteristics to vibrate and give a ringing sound when struck;

a hollow handle extending from the barrel in a direction substantially opposite said sound bow of the housing and communicating with the interior of the barrel, said handle being provided with an opening in the outer extremity thereof remote from the barrel;

an ornamental clapper having an aesthetic, distinctive appearance representative of a particular motif;

an elongated flexible support element for the clapper;

means for suspending the clapper from one end of the support element;

a connector secured to the opposite end of the support element and aligned with said opening in the handle; and a decorative fastener resting on the handle, extending through said opening and releasably joined to the connector for removable support of the clapper and flexible element from the handle.

2. A bell and clapper assembly as set forth in claim 1 wherein said connector comprises an internally threaded sleeve and the fastener is externally threaded for removable receipt in the sleeve, said fastener having structure thereon engageable with the outer surface of the handle in surrounding relationship to said opening therein.

3. A bell and clapper assembly as set forth in claim 2 wherein said fastener includes an externally threaded post adapted for removable, threaded receipt by said sleeve and said structure includes means extending from one end of the post laterally of the longitudinal axis and engageable with the handle for limiting telescoping passage of the post through said opening in the handle.

4. A bell and clapper assembly as set forth in claim 3 wherein said support element comprises a chain secured at opposite ends thereof to said clapper and the connector respectively.

5. A bell and clapper assembly as set forth in claim 3 wherein said structure defines a rosette with the threaded post being secured to the rosette substantially at the center thereof.

6. A bell and clapper assembly as set forth in claim 1 wherein said housing and the handle are of glass and integrally joined.

7. A bell and clapper assembly as set forth in claim 1 wherein one of said barrel and the handle is provided with a decorative design pattern thereon.

8. A bell and clapper assembly as set forth in claim 1 wherein is provided means releasably securing the clapper to said flexible support to permit interchange of the clapper with other design motifs.

* * * * *